US009926746B2

(12) United States Patent
Gao et al.

(10) Patent No.: US 9,926,746 B2
(45) Date of Patent: Mar. 27, 2018

(54) ACTUATING A DOWNHOLE TOOL

(71) Applicant: Smith International, Inc., Houston, TX (US)

(72) Inventors: Rui Gao, Spring, TX (US); Sudarsanam Chellappa, Houston, TX (US); James Layne Larsen, Spring, TX (US); Yaou Wang, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 592 days.

(21) Appl. No.: 14/306,302

(22) Filed: Jun. 17, 2014

(65) Prior Publication Data

US 2014/0374163 A1 Dec. 25, 2014

Related U.S. Application Data

(60) Provisional application No. 61/836,944, filed on Jun. 19, 2013.

(51) Int. Cl.
*E21B 10/32* (2006.01)

(52) U.S. Cl.
CPC ..... *E21B 10/322* (2013.01)

(58) Field of Classification Search
CPC ..... E21B 34/14; E21B 10/32; E21B 10/322; E21B 10/26
See application file for complete search history.

(56) References Cited

U.S. PATENT DOCUMENTS

| | | | |
|---|---|---|---|
| 4,600,062 | A | 7/1986 | Teng |
| 5,123,694 | A | 6/1992 | Depierre et al. |
| 5,403,049 | A | 4/1995 | Ebbinghaus |
| 5,598,904 | A | 2/1997 | Spyche |
| 6,027,105 | A | 2/2000 | Dohrmann et al. |
| 6,065,573 | A | 5/2000 | Kelly |
| 6,557,674 | B2 | 5/2003 | Vignocchi et al. |
| 6,695,104 | B2 | 2/2004 | Akad |
| 7,866,397 | B2 | 1/2011 | Lee |
| 8,201,643 | B2 | 6/2012 | Soby et al. |
| 2007/0089912 | A1 | 4/2007 | Eddison et al. |
| 2009/0266659 | A1 | 10/2009 | Lembcke et al. |
| 2011/0114334 | A1 | 5/2011 | Palacios |

OTHER PUBLICATIONS

International Search Report and Written Opinion issued in PCT/US2014/042827 on Oct. 27, 2014, 17 pages.

*Primary Examiner* — Taras P Bemko
*Assistant Examiner* — Manuel C Portocarrero

(57) ABSTRACT

A downhole tool includes a body having a bore extending at least partially therethrough. A component is disposed within the bore and arranged and designed to move axially from a first position to a second position within the bore. An axial end portion of the component has a first contact surface that is oriented at an angle from about 1° to about 45° with respect to a longitudinal axis extending through the component.

19 Claims, 7 Drawing Sheets

ACTUATING A DOWNHOLE TOOL

CROSS-REFERENCE TO RELATED APPLICATIONS

The present application claims priority to U.S. Provisional Application 61/836,944, filed Jun. 19, 2013, the entirety of which is incorporated by reference.

BACKGROUND

An underreamer includes one or more cutter blocks that expand radially-outward to increase the diameter of a wellbore when the underreamer is actuated from a retracted state to an expanded state. More particularly, the underreamer may include a sleeve that moves axially from a first position to a second position. The sleeve obstructs an opening in the body of the underreamer when in the first position and allows fluid flow through the opening when in the second position. When the sleeve is in the second position, fluid flows through the opening and exerts a hydraulic force on a piston, causing the piston to move the cutter blocks into the expanded state.

As the sleeve accelerates into the second position, the sleeve may contact a stationary component (e.g., a shoulder) in the body of the underreamer, which halts further axial movement of the sleeve. The resulting impact between the sleeve and the shoulder, however, may subject portions of the sleeve to a high plastic deformation. More particularly, the sleeve may have one or more radial ports or openings formed therethrough, and the impact may subject the portion of the sleeve proximate the openings to a large plastic strain. This may cause the portion of the sleeve proximate the openings to deform, which may inhibit the function and prevent further use of the underreamer.

What is needed, therefore, is an improved system and method for reducing plastic deformation and improving the reliability of impacting components in a downhole tool.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool includes a body having a bore extending at least partially therethrough. A component is disposed within the bore and may move axially from a first position to a second position within the bore. An axial end portion of the component has a first contact surface that is oriented at an angle from about 1° to about 45° with respect to a longitudinal axis extending through the component.

In another embodiment, the downhole tool may include a body having a bore extending at least partially therethrough. A first sleeve is disposed within the bore. The first sleeve has a first seat for receiving a first ball. A second sleeve is disposed within the bore and axially adjacent to the first sleeve. The second sleeve has a second seat for receiving a second ball. A third sleeve is disposed within the bore and radially-outward from at least one of the first and second sleeves. The third sleeve may move axially from a first position to a second position within the bore. An axial end portion of the third sleeve has a first contact surface that is oriented at an angle from about 1° to about 45° with respect to a longitudinal axis extending through the third sleeve.

A method for actuating as downhole tool is also disclosed. The method includes positioning a downhole tool in a wellbore. The downhole tool includes a body having a bore extending at least partially therethrough. First, second, and third sleeves may be disposed within the bore. The second sleeve is axially adjacent to the first sleeve. The third sleeve is radially-outward from at least one of the first and second sleeves. An axial end portion of the third sleeve has a first contact surface that is oriented at an angle from about 1° about 45° with respect to a longitudinal axis extending through the third sleeve. One or more cutter blocks may be moveably coupled to the body. A first ball may be introduced into the bore and engage a first seat formed in the first sleeve. A pressure of a fluid in the bore may be increased. One or more shear elements coupling the first sleeve to the body may deform or shear in response to the increased pressure of the fluid causing the first sleeve to move from a first axial position to a second axial position within the bore. The movement of the first sleeve uncovers one or more openings formed in the third sleeve. The one or more cutter blocks move axially toward a first end portion of the body and radially-outward in response to the fluid flowing from the bore, through the openings and into a piston chamber formed in the body.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
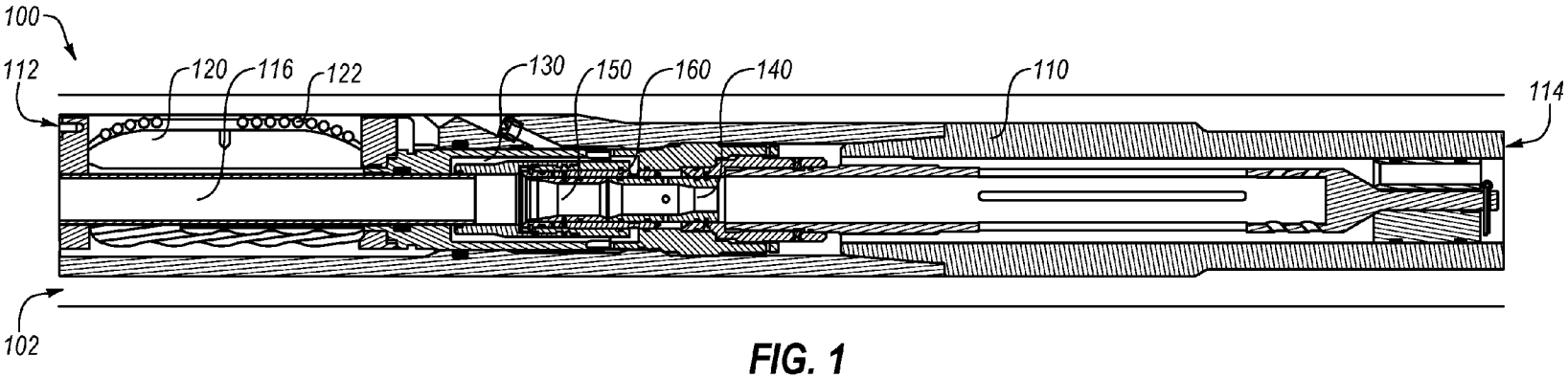
FIG. 1 depicts a partial cross-sectional view of an illustrative downhole tool in a retracted state, according to one or more embodiments disclosed.

Embodiments described herein generally relate to a system and method for improving impact absorption of components in a downhole tool. More particularly, embodiments described herein relate to a system and method for improving impact absorption (and thereby reducing plastic deformation) in a moving component in a downhole tool such as an underreamer.

As generally shown in FIGS. 1-4, a downhole tool 199 includes a body 110 having a bore 116 extending at least partially therethrough. A component (e.g., a sleeve) 160 is disposed within the bore 116 and arranged and designed to move axially from a first position to a second position within the bore 116. An axial end portion 164 of the component 160 has a first contact surface 310 that is oriented at an angle from about 1° to about 45° with respect to a longitudinal axis 314 extending through the component 160.

FIG. 1 depicts a partial cross-sectional view of an illustrative downhole tool 100 in a retracted state, according to one or more embodiments. As shown, the downhole tool 100 is an underreamer that is configured to increase a diameter of a wellbore 102 from a first "pilot hole" diameter to a second diameter. However, as may be appreciated, the downhole tool 100 may be any tool designed to be run into a wellbore 102 that has one or more moveable components (e.g., sliding sleeves) for opening and closing flow ports. For example, the downhole tool 100 may be a bypass valve.

The downhole tool 100 includes a body 110 having a first end portion 112, a second end portion 114, and an axial bore 116 formed at least partially therethrough. The body 110 may be or include a single integral component, or the body 110 may include two or more components coupled together. One or more cutter blocks 120 may be moveably coupled to the body 110. The number of cutter blocks 120 may range from a low of 1, 2, 3, or 4 to a high of 6, 8, 10, 12, or more. The cutter blocks 120 may be axially and/or circumferentially offset from one another. For example, the downhole tool 100 may include three cutter blocks 120 that are circumferentially offset from one another.

The cutter blocks 120 may each have a plurality of cutting contacts or inserts 122 disposed on an outer radial surface thereof. In at least one embodiment, the cutting inserts 122 may include polycrystalline diamond cutters ("PDCs") or the like. The cutting inserts 122 cut, grind, or scrape the wall of the wellbore 102 to increase the diameter thereof when the downhole tool 100 is in an expanded state, as described in more detail below.

The cutter blocks 120 may also have a plurality of stabilizing pads or inserts (not shown) disposed on the outer radial surfaces thereof. The stabilizing inserts may be or include tungsten carbide inserts, or the like. The stabilizing inserts absorb and reduce vibration between the cutter blocks 120 and the well of the wellbore 102.

The body 110 may have a piston chamber 130 formed therein. The downhole tool 100 may be in the retracted state when the chamber 130 is isolated from the bore 116 (e.g., by a sleeve, as discussed in more detail below). When the downhole tool 100 is in the retracted state, the cutter blocks 120 are folded into or retracted into corresponding apertures or cavities in the body 110 such that the outer surfaces of the cuter blocks 120 are aligned with, or positioned radially-inward from, the outer surface of the body 110. As such, the downhole tool 100 may be raised or lowered through restrictions in the wellbore 102 (e.g., casing shoes) without contact with the cutter blocks 120.

Figure 2:
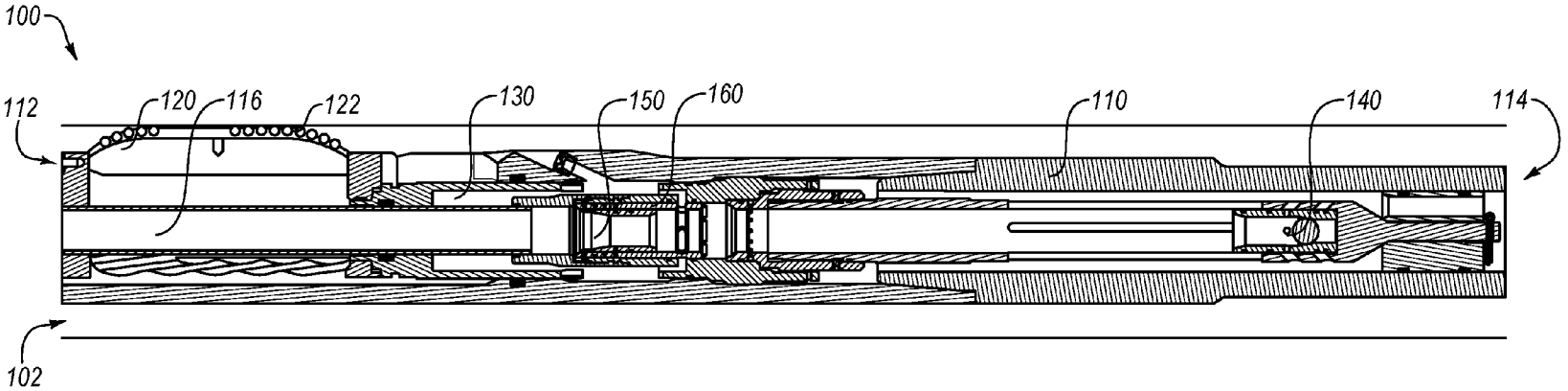
FIG. 2 depicts a partial cross-sectional view of the downhole tool in an expanded state, according to one or more embodiments disclosed.

FIG. 2 depicts a partial cross-sectional view of the downhole tool 100 in an expanded state, according to one or more embodiments. The downhole tool 100 may be in the expanded state when the chamber 130 is in fluid communication with the bore 116 and the pressure of the fluid in the bore 116 and the chamber 130 increases above a predetermined amount. The pressurized fluid in the chamber 130 exerts a force on the cutter blocks 120 in a direction toward the first end portion 112 of the body 110. When the force exerted by the fluid becomes greater than an opposing force exerted by a spring (not shown), the cutter blocks 120 simultaneously move axially toward the first end portion 112 of the body 110 and radially-outward (e.g., on tracks or splines), thereby actuating the downhole tool 100 into the expanded state.

When the downhole tool 100 is in the expanded state, the cutter blocks 120 are expanded and may cut or grind the wall of the wellbore 102, thereby increasing the diameter of the wellbore 102 from the first diameter to the predetermined second diameter. The second diameter may be greater than the first diameter by about 5% to about 20%, about 15% to about 25%, about 20% to about 30%, about 25% to about 35% about 30% to about 40%, or more.

One or more moveable components, such as annular sleeves, may be disposed within the bore 116 of the body 110. As shown, the bore 116 has a first sleeve 140, a second sleeve 150, and a third sleeve 160 disposed therein. The first sleeve 140 may be at least partially disposed within the third sleeve 160 when the downhole tool 100 is in the initial, retracted state. The second sleeve 150 may be axially adjacent to the first sleeve 140 and at least partially disposed within the third sleeve 160 when the downhole tool 100 is in the initial, retracted state.

Figure 3:
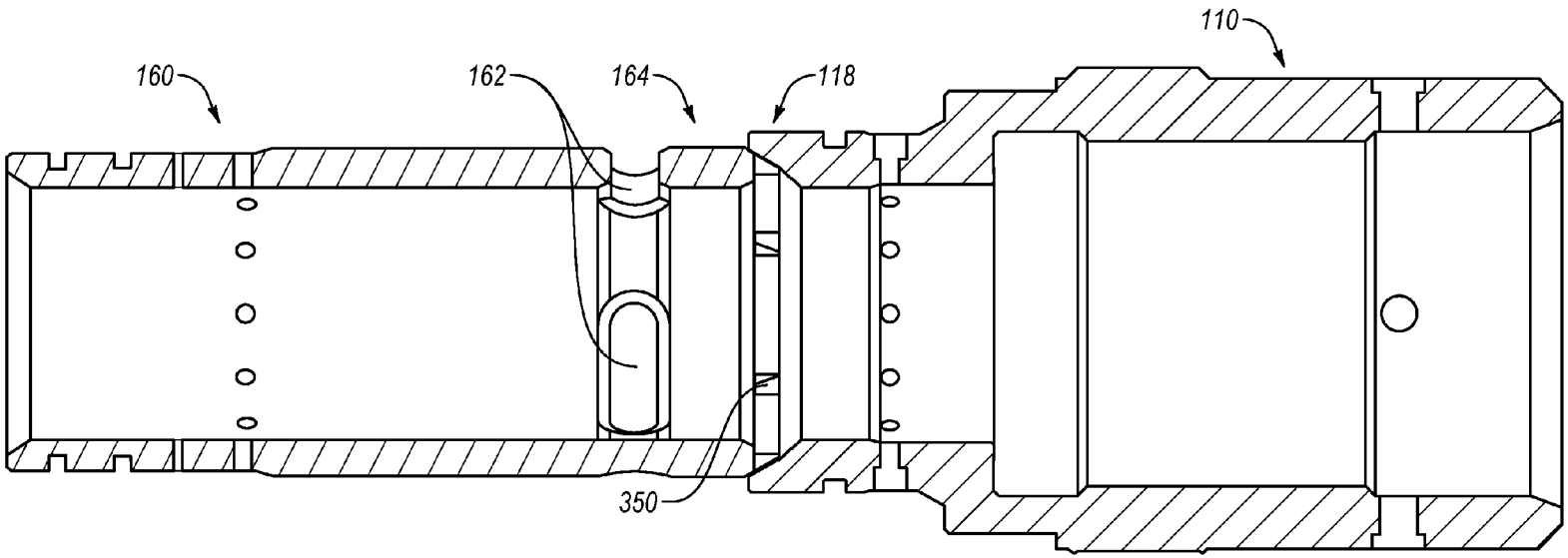
FIG. 3 depicts a cross-sectional view of an axial end portion of a sleeve contacting a shoulder in the body, according to one or more embodiments disclosed.

FIG. 3 depicts a cross-section view of an axial end portion 164 of the third sleeve 160 contacting a shoulder 118 in the body 110, according to one or more embodiments. The third sleeve 160 may be positioned radially-outward from the first and/or second sleeves 140, 150 when the downhole tool 100 is in the initial, retracted state. The third sleeve 160 may have one or more ports or openings 162 formed radially therethrough. For example, the third sleeve 160 may include between two openings 162 and eight openings 162 that are circumferentially offset from one another. The openings 162 are arranged and designed to provide a path of fluid communication from the bore 116 into the chamber 130. However, when the downhole tool 100 is in the initial, retracted state (FIG. 1), the first sleeve 140 may at least partially cover or obstruct the openings 162, thereby preventing fluid from flowing from the bore 116 into the chamber 130. The third sleeve 160 may be arranged and designed to move or slide axially within the bore 116 from a first position to a second position. The third sleeve 160 may move until an axial end portion 164 of the third sleeve 160 contacts a shoulder 118 defined or formed on an inner surface of the body 110. The shoulder 118 may halt further movement of the third sleeve 160, leaving the third sleeve 160 in the second position.

Figure 4:
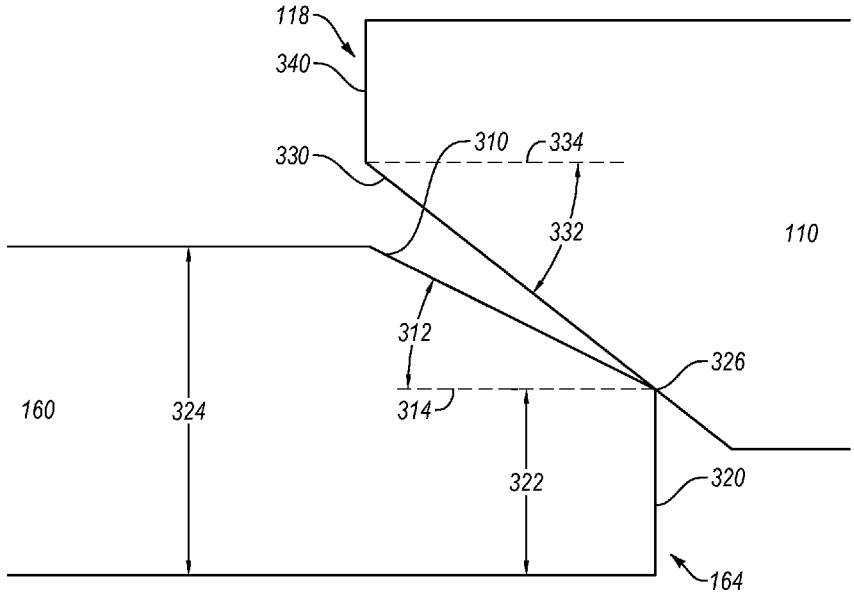
FIG. 4 depicts a schematic side view of the axial end portion of the sleeve contacting the shoulder in the body, according to one or more embodiments disclosed.

FIG. 4 depicts a schematic side view of the axial end portion 164 of the third sleeve 160 contacting the shoulder 118 of the body 110, according to one or more embodiments. Referring to FIGS. 3 and 4, the axial end portion 164 of the third sleeve 160 may have a first contact surface 310 and a second contact surface 320. The first contact surface 310 is oriented at an angle 312 with respect to the longitudinal centerline 314 through the third sleeve 160. As such, the diameter of the first contact surface 310 may increase moving farther away from a second contact surface 320. The angle 312 may be from about 1° to about 45° or about 5° to about 30°. In another embodiment, the angle 312 may be from about to about 5°, about 5° to about 10°, about 10° to about 20°, about 20° to about 20°, about 30° to about 40°, about 40° to about 50°, about 50° to about 60°, or more.

The second contact surface be substantially perpendicular to the longitudinal axis 314 extending through the third sleeve 160. A thickness 322 (measured in a radial direction) of the second contact surface 320 may be less than a thickness 324 (measured in a radial direction) of the third sleeve 160 at its thickest point. The thickness 322 of the second contact surface 320 may be from about 5% to about 75% or about 10% to about 50% of the thickness 324 of the third sleeve 160 at its thickest point. In another embodiment, the thickness 322 of the second contact surface 320 may from about 1% to about 10%, about 10% to about 25%, about 25% to about 50%, or about 50% to about 75% of the thickness 324 of the third sleeve 160 at its thickest point.

The shoulder 118 may have a first contact surface 330 and a second contact surface 340. The first contact surface 330 may be oriented at an angle 332 with respect to the longitudinal axis 334 extending through the body 110 or the third sleeve 160), and the second contact surface 340 may be substantially perpendicular to the longitudinal axis 334 extending through the body 110 (or the third sleeve 160). As such, the diameter of the first contact surface 330 may increase moving farther away from the second contact surface 340. For example, the angle 332 may be from about 20° to about 70° or about 30° to about 60°. In another embodiment, the angle 332 may be from about 10° to about 20°, about 20° to about 30°, about 30° to about 40°, about 40° to about 50°, about 50° to about 60°, about 60° to about 70°, about 70° to about 80°, or more.

The angle 332 of the shoulder 118 may be greater than the angle 312 of the third sleeve 160. As a result, the point of initial contact on the third sleeve 160 may be the intersection 326 between the first and second contact surfaces 310, 320. The point of initial contact on the shoulder 118 may be on the first contact surface 330 thereof. This may cause the axial end portion 164 of the third sleeve 160 to sacrificially absorb an increased amount of the impact energy. Increasing the amount of impact energy absorbed by the axial end portion 164 of the third sleeve 160 may reduce the amount of impact energy absorbed in other portions of the third sleeve 160 (e.g., proximate the openings 162—see FIG. 3). This may increase the likelihood of deformation in the axial end portion 164 of the third sleeve 160, which thereby decreases the likelihood of deformation proximate the openings 162.

Moreover, the axial end portion 164 of the third sleeve 160 may also have one or more axial slots or grooves 350 (FIG. 3) cut or otherwise formed therein. For example, the axial end portion 164 may have a plurality of grooves 350 formed therein that are circumferentially offset from one another. The grooves 350 may further increase the likelihood of deformation in the axial end portion 164 of the third sleeve 160, thereby decreasing the likelihood of deformation proximate the openings 162.

Figure 5:
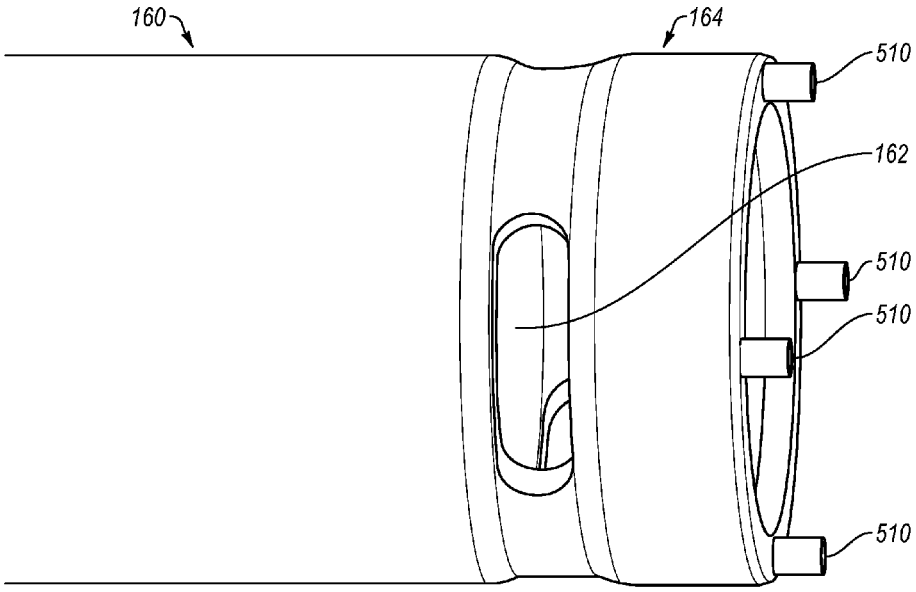
FIG. 5 depicts a partial perspective view of the sleeve having one or more illustrative pins extending axially therefrom, according to one or more embodiments disclosed.

FIG. 5 depicts a partial perspective view of the third sleeve 160 having one or more illustrative pins 510 extending from the axial end portion 164 thereof, according to one or more embodiments. The third sleeve 160 may have one or more openings (not shown) formed in the axial end portion 164 thereof. For example, the third sleeve 160 may have a plurality of openings formed in the axial end portion 164 thereof and circumferentially offset from one another. Each opening may be sized to receive a corresponding pin 510. Once inserted, the pins 510 may be coupled to the axial end portion 164 via as friction or interference fit, an adhesive, welding, brazing, or the like.

The pins 510 are arranged and designed to absorb a portion of the impact energy when the third sleeve 160 contacts the shoulder 118. This may reduce the amount of impact energy absorbed proximate the openings 162, which thereby decreases the likelihood of deformation proximate the openings 162. To facilitate this, the pins 510 may be made of a material that is structurally weaker than the third sleeve 160. In at least one embodiment, the pins 510 may be made from brass or steel, and the third sleeve 160 may be made from AISI 41xx or 43xx steel. For example, the pins 510 may be made of AISI 1040 steel, and the third sleeve 160 may be made of AISI 4140 steel. The shape, axial length, cross-sectional length, and number of the pins 510 may be varied to reduce the impact energy absorbed proximate the openings 162.

Figure 6:
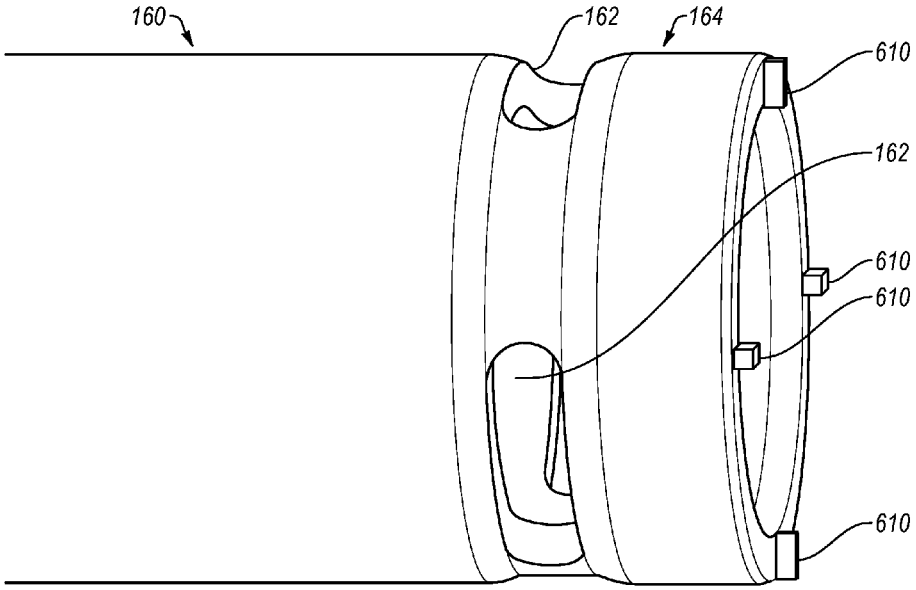
FIG. 6 depicts a partial perspective view of the sleeve having one or more illustrative fingers extending axially therefrom, according to one or more embodiments disclosed.

FIG. 6 depicts a partial perspective view of the third sleeve 160 having one or more illustrative fingers 610 extending axially therefrom, according to one or more embodiments. The fingers 610 may serve the same function as the pins 510 (i.e., to absorb a portion of the impact energy when the third sleeve 160 contacts the shoulder 118). The pins 510 may have a generally circular cross-section shape while the fingers 610 may have an ovular cross-section shape. More particularly, the radial length of the fingers 610 may be greater than as circumferential length. However, as may be appreciated, the cross-sectional shape of the pins 510 and/or fingers 610 may be as circle, oval, square, rectangle, or the like.

Figure 7:
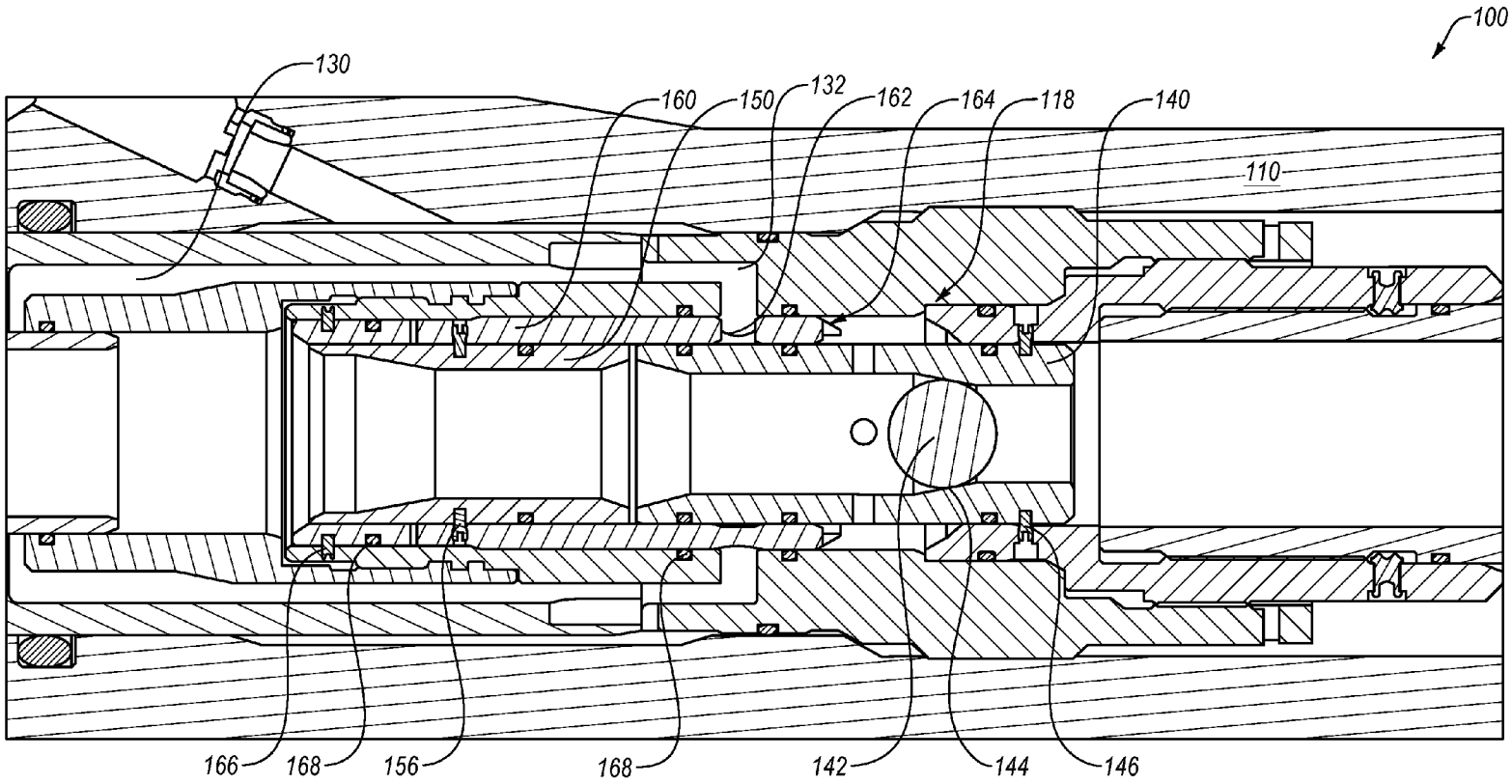
FIG. 7 depicts a partial cross-section view of the downhole tool in a retracted state, according to one or more embodiments disclosed.
Figure 8:
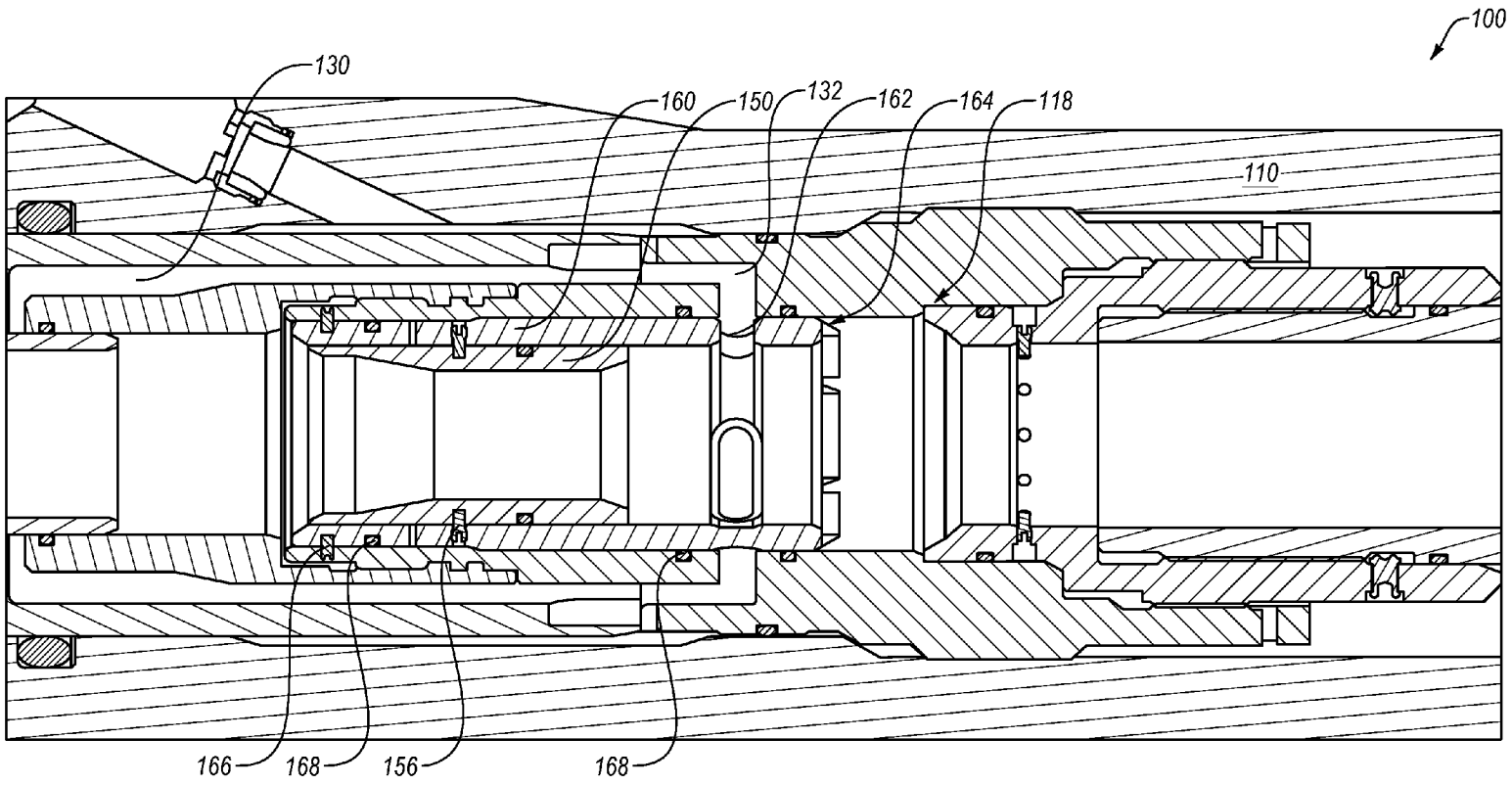
FIG. 8 depicts a partial cross-section view of the downhole tool in an expanded state, according to one or more embodiments disclosed.
Figure 9:
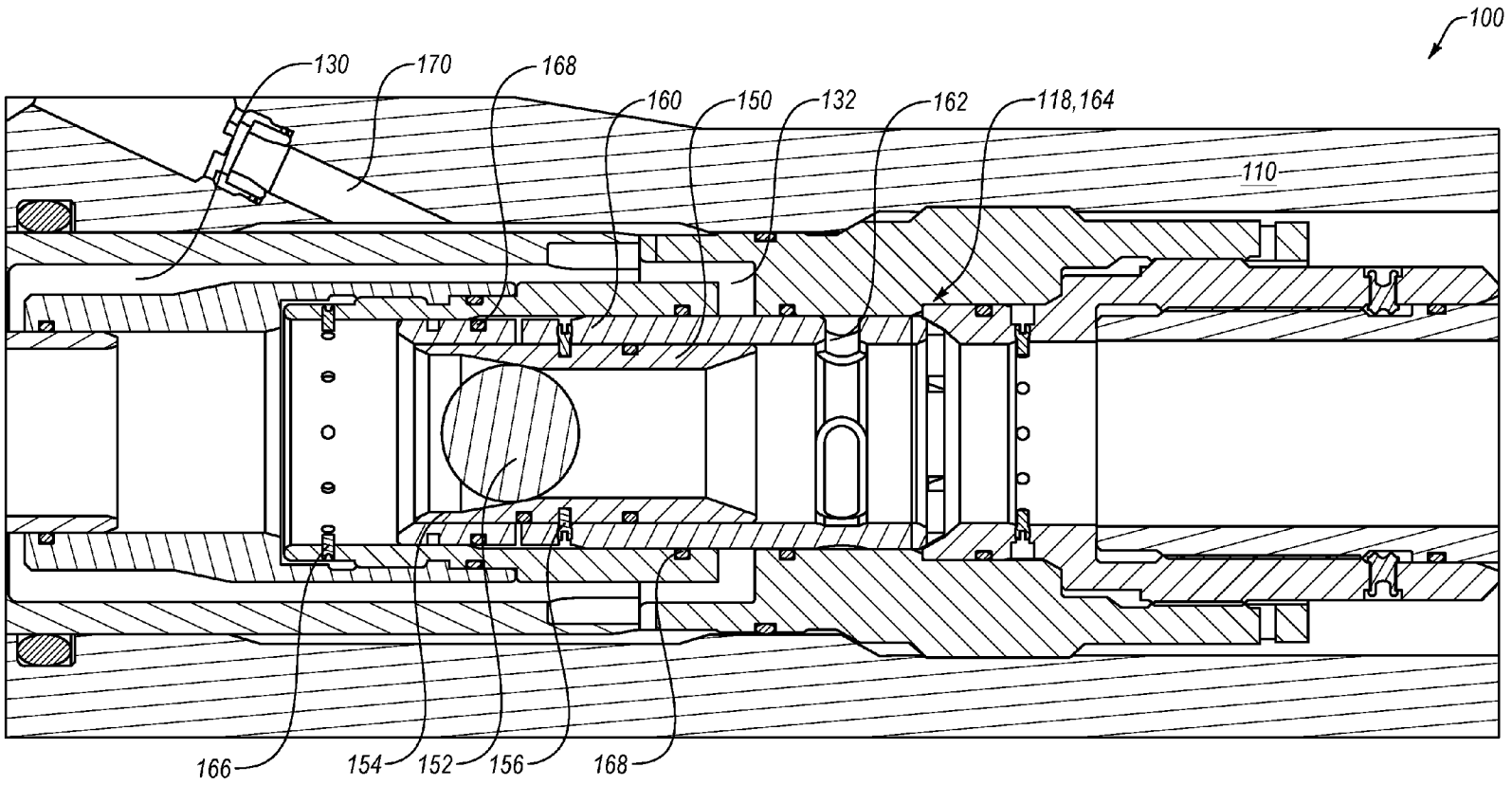
FIG. 9 depicts a partial cross-section view of the downhole tool after actuating back into the retracted state, according to one or more embodiments disclosed.

FIGS. 7-9 illustrate the operation of the downhole tool 100. More particularly, FIG. 7 depicts a partial cross-section view of the downhole tool 100 in the initial, retracted state, according to one or more embodiments. In the initial, retracted state, the openings 162 in the third sleeve 160 may be aligned with an inlet 132 to the chamber 130. The first sleeve 140, however, may be positioned such that the first sleeve 140 at least partially covers or obstructs the openings 162, thereby preventing fluid from flowing from the bore 116 and into the chamber 130.

The first sleeve 140 may be held in place by one or more shear elements 146 that couple the first sleeve 140 to the body 110. The second sleeve 150 may be held in place by one or more shear elements 156 that couple the second sleeve 150 to the third sleeve 160. The third sleeve 160 may be held in place by one or more shear elements 166 that couple the third sleeve 160 to the body 110. As used herein, "shear element" refers to any element that is arranged and designed to couple two components together and to deform or shear when exposed to a predetermined force, thereby decoupling the two components. Illustrative shear elements 146, 156, 166 may be or include shear pins, shear threads, shear grooves, and the like.

A first ball 142 may be introduced into the bore 116 of the body 110 through the first end portion thereof 112. For example, the first ball 142 may be dropped into the drill string (not shown) from the surface and travel through the drill string and into the bore 116 of the body 110. The first ball 142 may pass through the second sleeve 150 and engage a seat 144 in the first sleeve 140.

A pump (not shown) disposed at the surface may pump fluid through the drill string and into the bore 116 of the body 110. The first ball 142 may obstruct fluid flow through the bore 116 toward the second end portion 114 of the body 110 when engaged with the seat 144. As a result, the pressure of the fluid in the bore 116 may increase. The pressure exerts a force on the first ball 142 and the first sleeve 140 in a direction toward the second end portion 114 of the body 110. The shear elements 146 coupling the first sleeve 140 to the body 110 may deform or shear when the force reaches a predetermined amount causing the first ball 142 and the first sleeve 140 to move or slide axially through the bore 116 toward the second end portion 114 of the body 110.

FIG. 8 depicts a partial cross-sectional view of the downhole tool 100 in the expanded state, according to one or more embodiments. The movement of the first sleeve 140 uncovers the openings 162 in the third sleeve 160, thereby creating a path of fluid communication from the bore 116, through openings 162 in the third sleeve 160, through the inlet 132, and into the chamber 130. The pressure of the fluid in the chamber 130 may exert a force on a drive ring (not shown) that causes the cutter blocks 120 to simultaneously move axially toward the first end portion 112 of the body 110 and radially-outward, thereby actuating the downhole tool 100 into the expanded state (see FIG. 2). The downhole tool 100 may then be moved axially within the wellbore 102 to increase the diameter of the wellbore 102 from the first diameter to the second diameter.

FIG. 9 depicts a partial cross-sectional view of the downhole tool 100 after actuating back into the retracted state, according to one or more embodiments. After the downhole tool 100 has increased the diameter of the desired portion of the wellbore 102, the downhole tool 100 may be actuated back into the retracted state. To accomplish this, a second, lamer ball 152 may be introduced into the bore 116 of the body 110 through the first end portion 112 thereof. For example, the second ball 152 may be dropped into the drill string (not shown) from the surface and travel through the drill string and into the bore 116 of the body 110. The second ball 152 may engage a seat 154 in the second sleeve 150.

The pump may pump fluid through the drill string and into the bore 116 of the body 110. The second ball 152 may obstruct fluid flow through the bore 116 toward the second end portion 114 of the body 110 when engaged with the seat 154. As a result, the pressure of the fluid in the bore 116 may increase. The pressure exerts a force on the second ball 152 and the second sleeve 150 in a direction toward the second end portion 114 of the body 110.

The shear elements 166 coupling the third sleeve 160 to the body 110 may deform or shear when the force reaches a predetermined amount causing the second ball 152, the second sleeve 150, and the third sleeve 160 to move or slide axially through the bore 116 toward the second end portion 114 of the body 110 from a first position to a second position. One or more seals 168 may be disposed between the third sleeve 160 and the body 110 and prevent axial fluid flow therethrough. In at least one embodiment, one or more of the seals 168 may be coupled to the body 110, and one or more of the seals 168 may be coupled to the third sleeve 160 and adapted to move or slide therewith. The seals 168 may be made from rubber, an elastomer, lapped carbide, Teflon®, metal rings, or the like.

The second ball, the second sleeve 150, and the third sleeve 160 come to rest in the second position when the axial end portion 164 of the third sleeve 160 contacts the shoulder 118 in the body 110 (see also FIGS. 3, 4). As discussed above, the design of the axial end portion 164 of the third sleeve 160 may increase the amount of impact energy absorbed by the axial end portion 164 of the third sleeve 160, thereby reducing the amount of impact energy absorbed proximate the openings 162. This may decrease the likelihood of deformation proximate the openings 162.

The openings 162 in the third sleeve 160 are no longer aligned with the inlets 132 to the chamber 130 when the third sleeve 160 is in the second position. As a result, the third sleeve 160 blocks or obstructs the inlet 132 to the chamber 130 when in the second position. The pressure of the fluid in the chamber 130 decreases as a portion of the fluid therein flows through a nozzle 170 and into the annulus outside the body 110. As the pressure of the fluid in the chamber 130 decreases, so does the force exerted on the cutter blocks 120. When the force exerted on the cutter blocks 120 by the fluid decreases below the opposing force exerted by the compressed spring, the cutter blocks 120 simultaneously move axially toward the second end portion 114 of the body 110 and radially-inward, thereby actuating the downhole tool 100 back into the retracted state. As shown, the second ball 152 continues to block or obstruct the flowpath through the bore 116 of the body 110.

As the second ball 152 continues to block or obstruct the flowpath through the bore 116 of the body 110, the pressure of the fluid in the bore 116 may continue to increase. The shear elements 136 coupling the second sleeve 150 to the third sleeve 160 may deform or shear when the force reaches a predetermined amount causing the second ball 152 and the second sleeve 150 to move or slide axially through the bore 116 toward the second end portion 114 of the body 110. Once the second ball 152 and the second sleeve 150 move, the flowpath through the bore 116 of the body 110 is reestablished.

As used herein, the terms "inner" and "outer"; "up" and "down"; "upper" and "lower"; "upward" and "downward", "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Actuating a Downhole Tool." Accordingly, all such modifications are intended, to be included within the scope of this disclosure. In the claims, means-plus-function clauses are intended to cover the structures described herein as performing the recited function and not only structural equivalents, but also equivalent structures. Thus, although as nail and a screw ma not be structural equivalents in that a nail employs a cylindrical surface to secure wooden parts together, whereas a screw employs a helical surface, in the environment of fastening wooden parts, a nail and a screw may be equivalent structures.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of an two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A downhole tool, comprising:

a body having a bore extending at least partially therethrough;

a component disposed within the bore and configured to move axially from a first position to a second position within the bore, an axial end portion of the component having a first contact surface that is oriented at an angle from about 1° to about 45° with respect to a longitudinal axis extending through the component, the component coupled to the body with one or more first shear elements and including one or more ports aligned with an inlet to a piston chamber in the body before shearing of the first shear elements and while the component is at the first position, and the component blocking the inlet to the piston chamber after shearing of the first shear elements and while the component is at the second position;

a first sleeve at least partially within the component and coupled to the body by one or more second shear elements, the first sleeve blocking the one or more ports in the component before shearing of the one or more second shear elements and uncovering the one or more ports in the component after shearing of the one or more second shear elements; and a second sleeve at least partially within the component and coupled to the component by one or more third shear elements, the second sleeve allowing fluid flow through the one or more ports before shearing of the third shear elements, the downhole tool configured to shear the one or more first shear elements after shearing the one or more second shear elements and before shearing the one or more third shear elements.

2. The downhole tool of claim 1, wherein the component is an annular sleeve.

3. The downhole tool of claim 1, wherein the axial end portion has a second contact surface that is substantially perpendicular to the longitudinal axis of the component.

4. The downhole tool of claim 3, wherein a thickness of the second contact surface is from about 5% to about 75% of a thickness of the component as measured from a thickest point of the component.

5. The downhole tool of claim 3, wherein a diameter of the first contact surface increases moving farther away from a second contact surface.

6. The downhole tool of claim 3, wherein a shoulder is formed on an inner surface of the body, and wherein the shoulder has a first contact surface that is oriented at an angle from about 20° to about 70° with respect to a longitudinal axis extending through the body.

7. The downhole tool of claim 6, wherein an intersection between the first and second contact surfaces of the axial end portion of the component contacts the first contact surface of the shoulder when the component is in the second position.

8. The downhole tool of claim 1, wherein the downhole tool is an underreamer.

9. The downhole tool of claim 1, further comprising:

a plurality of pins that are circumferentially offset from one another and extending axially away from the axial end portion of the component, wherein the pins are designed to be structurally weaker than the component such that the pins deform when the pins contact a shoulder formed on an inner surface of the body.

10. The downhole tool of claim 9, wherein the pins are made from a material that is structurally weaker than the component.

11. The downhole tool of claim 9, the plurality of pins having a circular or ovular cross-sectional shape in a radial dimension and extending along, and circumferentially around, the longitudinal axis.

12. A downhole tool, comprising:

a body having a bore extending at least partially therethrough, wherein a shoulder is formed on an inner surface of the body, and wherein the shoulder has a first contact surface that is oriented at a first angle from about 20° to about 70° with respect to a longitudinal axis extending through the body;

a first sleeve disposed within the bore, the first sleeve having a first seat arranged and designed to receive a first ball;

a second sleeve disposed within the bore and axially adjacent to the first sleeve, the second sleeve having a second seat arranged and designed to receive a second ball; and a third sleeve disposed within the bore and radially-outward from at least one of the first and second sleeves, the third sleeve being arranged and designed to move axially from a first position to a second position within the bore, an axial end portion of the third sleeve having a first contact surface that is oriented at a second angle from about 1° to about 45° with respect to a longitudinal axis extending through the third sleeve, wherein the first angle is greater than the second angle, and wherein the third sleeve contacts the shoulder when at the second position.

13. The downhole tool of claim 12, wherein the third sleeve has at least one opening formed radially therethrough that is aligned with an inlet to a chamber formed in the body when the third sleeve is in the first position.

14. The downhole tool of claim 13, further comprising at least one cutter block moveably coupled to the body, wherein the at least one cutter block is arranged and designed to simultaneously move axially toward a first end portion of the body and radially-outward when pressurized fluid flows from the bore, through the openings, through the inlet, and into the chamber.

15. The downhole tool of claim 12, wherein the first angle is from about 30° to about 40° and the second angle is from about 20° to about 30°.

16. The downhole tool of claim 12, wherein the third sleeve has a second contact surface that is substantially perpendicular to the longitudinal axis of the third sleeve, and wherein an intersection between the first and second contact surfaces of the axial end portion of the third sleeve initiates contact with the first contact surface of the shoulder when the third sleeve is in the second position.

17. The downhole tool of claim 12, further comprising a plurality of pins that are circumferentially offset from one another and extending axially from the axial end portion of the third sleeve, wherein the pins are designed to be structurally weaker than the third sleeve such that the pins deform when the pins contact a shoulder formed on an inner surface of the body.

18. A method for actuating a downhole tool, comprising:

positioning a downhole tool in a wellbore, the downhole tool including:

a body having a bore extending at least partially therethrough;

a first sleeve disposed within the bore;

a second sleeve disposed within the bore and axially adjacent to the first sleeve;

a third sleeve disposed within the bore and radially-outward from at least one of the first and second sleeves, an axial end portion of the third sleeve having a first contact surface that is oriented at an angle from about 1° to about 45° with respect to a longitudinal axis extending through the third sleeve; and at least one cutter block moveably coupled to the body;

introducing a first ball into the bore, wherein the first ball engages a first seat formed in the first sleeve;

increasing a pressure of a fluid in the bore, wherein one or more shear elements coupling the first sleeve to the body deform or shear in response to the increased pressure of the fluid causing the first sleeve to move from a first axial position to a second axial position within the bore, wherein the movement of the first sleeve uncovers one or more openings formed in the third sleeve, and wherein the at least one cutter block move axially toward a first end portion of the body and radially-outward in response to the fluid flowing from the bore, through the openings, and into a chamber formed in the body introducing a second ball into the bore after the first ball is introduced into the bore, wherein the second ball engages a second seat formed in the second sleeve; and shearing or deforming one or more shear elements coupling the third sleeve to the body in response to increased pressure of the fluid causing the second sleeve and the third sleeve to move from a first axial position to a second axial position within the bore, and wherein the axial end portion of the third sleeve contacts a shoulder formed on an inner surface of the body when the third sleeve is in the second position.

19. The method of claim 18, wherein the cutter blocks simultaneously move axially toward a second end portion of the body and radially-inward in response to the movement of the third sleeve.

* * * * *